US011324336B1

(12) United States Patent
Chen

(10) Patent No.: US 11,324,336 B1
(45) Date of Patent: May 10, 2022

(54) AIR CUSHION BED

(71) Applicant: FUZHOU NIANYUE INVESTMENT CONSULTING CO., LTD, Fuzhou (CN)

(72) Inventor: Huan Chen, Shaoyang (CN)

(73) Assignee: FUZHOU NIANYUE INVESTMENT CONSULTING CO., LTD, Fuzhou (CN)

( * ) Notice: Subject to any disclaimer, the term of this patent is extended or adjusted under 35 U.S.C. 154(b) by 0 days.

(21) Appl. No.: 17/536,121

(22) Filed: Nov. 29, 2021

(30) Foreign Application Priority Data

Sep. 29, 2021 (CN) ..... 202122376751.1

(51) Int. Cl.
*A47C 27/08* (2006.01)
*A47C 27/10* (2006.01)

(52) U.S. Cl.
CPC ..... *A47C 27/087* (2013.01); *A47C 27/082* (2013.01); *A47C 27/10* (2013.01); *A47C 27/08* (2013.01)

(58) Field of Classification Search
CPC ... A47C 27/087; A47C 27/082; A47C 27/081; A47C 27/08; A47C 27/10; A61G 7/05769; A61G 7/05776
USPC ..... 5/712, 711, 713, 710, 706, 644, 654, 5/655.3, 925, 926
See application file for complete search history.

(56) References Cited

U.S. PATENT DOCUMENTS 2,604,641 A * 7/1952 Reed ..... A47C 27/087 5/710
4,541,135 A * 9/1985 Karpov ..... A47C 27/10 5/710
5,111,544 A * 5/1992 Graebe ..... A47C 7/021 5/490
5,669,091 A * 9/1997 Chung ..... A47C 27/081 5/687
5,699,569 A * 12/1997 Schwarz-Zohrer ..... A47D 1/02 5/655
5,729,840 A * 3/1998 Wu ..... E04H 4/0025 4/588
6,009,873 A * 1/2000 Neviaser ..... A47C 20/027 128/DIG. 20
6,671,910 B2 * 1/2004 Hsu ..... A47C 27/087 5/710
6,789,283 B2 * 9/2004 Pirzada ..... A47C 27/18 5/713
7,254,853 B1 * 8/2007 Kim ..... A47C 27/087 5/710

(Continued)

*Primary Examiner* — Robert G Santos

(57) ABSTRACT

The present disclosure provides an air cushion bed, which includes an upper air cushion, a lower air cushion, and a pull belt body. The pull belt body is disposed between the upper air cushion and the lower air cushion, and is supported by the pull belt body. The pull belt body includes an annular belt body and longitudinal belt bodies, the annular belt body is disposed along four sides of the upper air cushion and the lower air cushion, and the annular belt body is further connected to the upper air cushion and the lower air cushion, the longitudinal belt bodies are disposed between the upper air cushion and the lower air cushion, and two ends of the longitudinal belt bodies are connected to the upper air cushion and the lower air cushion, the annular belt body includes a first sealed bag body structure spaced from the longitudinal belt bodies.

12 Claims, 1 Drawing Sheet

(56) References Cited

U.S. PATENT DOCUMENTS 7,269,866 B2 * 9/2007 Liu ..... A47C 27/082 5/710
7,353,555 B2 * 4/2008 Lau ..... A47C 27/081 5/711
7,406,735 B2 * 8/2008 Lin ..... A47C 27/081 5/711
7,591,036 B2 * 9/2009 Lin ..... A47C 27/081 5/713
7,610,642 B2 * 11/2009 Boyd ..... A47C 27/081 5/710
7,636,970 B2 * 12/2009 Lin ..... A47C 27/081 5/713
9,247,827 B2 * 2/2016 Lin ..... A47C 27/087
10,398,235 B2 * 9/2019 Lin ..... A47C 27/10
10,631,659 B2 * 4/2020 Xia ..... B29C 66/1122
10,687,633 B2 * 6/2020 Liu ..... A47C 27/087
2002/0148046 A1 * 10/2002 Pirzada ..... A47C 27/18 5/713
2003/0101516 A1 * 6/2003 Hsu ..... A47C 27/087 5/710
2004/0074004 A1 * 4/2004 Boso ..... A47C 27/088 5/710
2006/0218728 A1 * 10/2006 Liu ..... A47C 27/10 5/710
2007/0124864 A1 * 6/2007 Lau ..... A47C 27/081 5/711
2007/0283499 A1 * 12/2007 Lin ..... A47C 27/081 5/713
2008/0078032 A1 * 4/2008 Boyd ..... A47C 27/10 5/710
2008/0209642 A1 * 9/2008 Lin ..... A47C 27/087 5/713
2008/0209643 A1 * 9/2008 Lin ..... A47C 27/081 5/713
2015/0201760 A1 * 7/2015 Lin ..... A47C 27/10 5/710
2016/0183692 A1 * 6/2016 Lin ..... A47C 27/10 5/710
2017/0196368 A1 * 7/2017 Liu ..... A47C 27/16
2017/0215599 A2 * 8/2017 Lin ..... A47C 27/081
2017/0238718 A1 * 8/2017 Xia ..... B29C 65/04

* cited by examiner

AIR CUSHION BED

TECHNICAL FIELD

The present disclosure relates to a technical field of air cushion beds, in particular to an air cushion bed.

BACKGROUND

Air cushion beds are daily products in users' life, and a present air cushion bed generally includes an air cushion bed body, a first inflation and deflation nozzle is disposed on an outer wall of the air cushion bed body, when a user lies on the air cushion bed body, since there is no supporting body inside, a human body is prone to falling into the bed, which affects an experience of users.

Therefore, there is an urgent problem of how to provide an air cushion bed having a good supporting effect, and being convenient to use to be solved by those skilled in the art.

SUMMARY

Based on above, the present disclosure provides an air cushion bed having a good supporting effect and being convenient to use.

In order to achieve the above purpose, the present disclosure provides the following technical solution. The air cushion bed includes an upper air cushion, a lower air cushion, and a pull belt body. The pull belt body is disposed between the upper air cushion and the lower air cushion, and the upper air cushion and the lower air cushion are supported by the pull belt body; the pull belt body includes an annular belt body and longitudinal belt bodies, the annular belt body is disposed along four sides of the upper air cushion and the lower air cushion, and the annular belt body is further connected to the upper air cushion and the lower air cushion, the longitudinal belt bodies are disposed between the upper air cushion and the lower air cushion, and two ends of the longitudinal belt bodies are connected to the upper air cushion and the lower air cushion, the annular belt body has a first sealed bag body structure spaced from the longitudinal belt bodies.

Furthermore, the annular belt body includes an inner surrounding belt and an outer surrounding belt, the inner surrounding belt and the outer surrounding belt form the first sealed bag body structure, and the inner surrounding belt, the upper air cushion, and the lower air cushion form a second sealed bag body structure.

Furthermore, in the air cushion bed described above, a fabric layer is disposed on the upper air cushion.

Furthermore, in the air cushion bed described above, an air inlet is disposed on the annular belt body.

Furthermore, in the air cushion bed described above, a pump air device is disposed on the air inlet.

Furthermore, in the air cushion bed described above, the pump air device is a manual pump air machine.

Furthermore, in the air cushion bed described above, the pump air device is an electric pump air machine.

Furthermore, in the air cushion bed described above, at least one anti-slip member is disposed at a bottom of the lower air cushion.

According to technical solutions described above, compared with the prior art, the present disclosure provides the air cushion bed, in the present disclosure, by adopting the annular belt body and the longitudinal belt bodies for supporting, a longitudinal supporting force is improved, an effect of multi-point support is achieved by providing a plurality of longitudinal belt bodies, by connecting the longitudinal belt bodies to the upper air cushion and the lower air cushion to be an integrated structure, a volume of internal gas is reduced, and inflation efficiency is improved. An independent supporting effect is provided by the sealed bag body structures of the annular belt body, the annular belt body is disposed around the air cushion bed, which may provide an independent support for edges, so that both edge portions and a middle position of the air cushion bed have a supporting strength after the air cushion bed is inflated, during use, no matter a user lies in any position of the air cushion bed, the air cushion bed may be kept flat, the user may not fall on the ground. A comfort level is improved by disposing the fabric layer, so that the present disclosure has characteristics of a good supporting effect and convenient use.

BRIEF DESCRIPTION OF DRAWINGS

In order to more clearly illustrate technical solutions in embodiments of the present disclosure, drawings that need to be used in description of the embodiments or the prior art are briefly introduced below, obviously, the drawings in following description are merely some embodiments of the present disclosure, for those of ordinary skill in the art, other drawings may be obtained according to these drawings without creative efforts.

DETAILED DESCRIPTION

Technical solutions in embodiments of the present disclosure are clearly and completely described below with reference to accompanying drawings in the embodiments of the present disclosure, and obviously, the described embodiments are merely a part of embodiments of the present disclosure, rather than all of the embodiments. All other embodiments obtained by a person skilled in the art based on the embodiments of the present application without creative efforts shall fall within a protection scope of the present disclosure.

Figure 1:
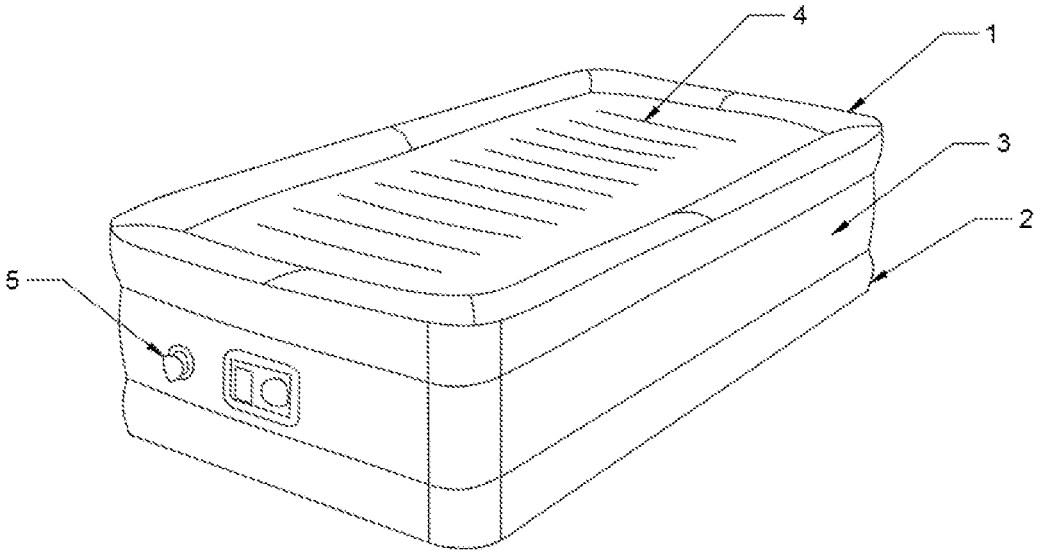
FIG. 1 is a schematic diagram of a structure of an air cushion bed according to the present disclosure.
Figure 2:
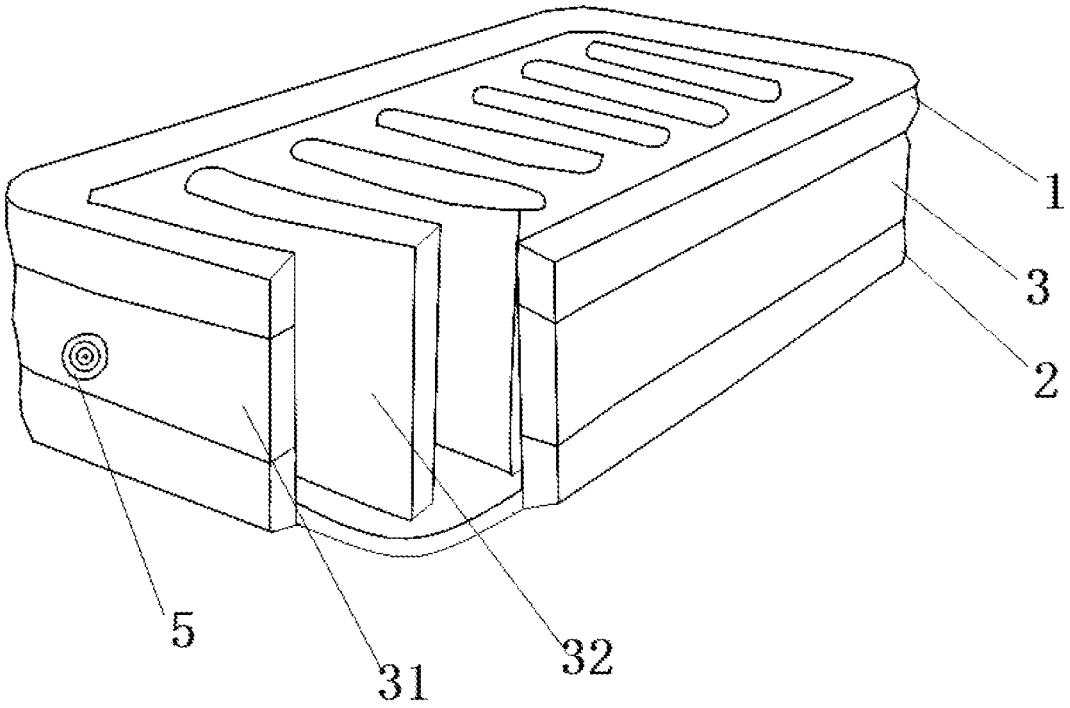
FIG. 2 is a schematic diagram of an internal structure of the air cushion bed according to the present disclosure.

Please refer to FIG. 1-2, which is an air cushion bed provided by the present disclosure.

The present disclosure includes an upper air cushion 1, a lower air cushion 2, and a pull belt body 3. The pull belt body 3 is disposed between the upper air cushion 1 and the lower air cushion 2, and the cushion 1 and the lower air cushion 2 are supported by pull belt body 3. The pull belt body 3 includes an annular belt body 31 and longitudinal belt bodies 32, the annular belt body 31 is disposed along four sides of the upper air cushion 1 and the lower air cushion 2, and the annular belt body 31 further is connected to the upper air cushion 1 and the lower air cushion 2, the longitudinal belt bodies 32 are disposed between the upper air cushion 1 and the lower air cushion 2, and two ends of the longitudinal belt bodies 32 are connected to the upper air cushion 1 and the lower air cushion 2, the annular belt body 31 includes a first sealed bag body structure spaced from the longitudinal belt bodies 32.

Exemplarily, the annular belt body 31 includes an inner surrounding belt and an outer surrounding belt. The inner surrounding belt and the outer surrounding belt form the first sealed bag body structure such as a first air chamber, and the inner surrounding belt, the upper air cushion, and the lower air cushion form a second sealed bag body structure such as a second air chamber, the first air chamber is independent of the second air chamber, that is, the first air chamber and the second air chamber are two independent air chambers.

In order to further optimize the above technical solution, a fabric layer 4 is disposed on the upper air cushion 1, the fabric layer 4 is disposed on a side of the upper air cushion 1 distal from the lower air cushion 2, and the fabric layer 4 may be configured to contact the user, a material of the fabric layer 4 may be set as required, for example, the material of the fabric layer 4 may be one or more of polyester, polyester spandex, polyester-cotton spandex, cotton cloth, linen, silk, velvet, leather, chemical fiber, blending, modal, etc.

In order to further optimize the above technical solution, an air inlet 5 is disposed on the annular belt body 31. The air inlet 5 may be disposed on any side of the annular belt body 31, and the annular belt body 31 can be easily inflated by the air inlet 5.

In order to further optimize the above technical solution, a pump air device is disposed on the air inlet 5.

In order to further optimize the above technical solution, the pump air device is a manual pump air machine. By using the manual pump air machine, gas can be filled into the first air chamber and the second air chamber, and it's not necessary to use an electrical equipment, which is convenient to use.

In order to further optimize the above technical solution, the pump air device is an electric pump air machine. The electric pump air machine can conveniently fill the gas into the first air chamber and the second air chamber, and the air cushion bed can be filled with air without spending much effort.

In order to further optimize the above technical solution, at least one anti-slip member is further disposed at a bottom of the lower air cushion. Specifically, one or more anti-skid members are disposed on a side of the lower air cushion 2 facing distal from the upper air cushion 1, the at least one anti-slip member may be a concave-convex structure or a surface-roughened component, the air cushion bed can be stably disposed on a placement surface by the at least one anti-slip member. For example, when the user sits or lies on the air cushion bed, the air cushion bed is not easily displaced.

In order to further optimize the above technical solution, during use, the gas is pumped by the pump air device, so that the gas enters a main air chamber enclosed by the lower air cushion 2 and the upper air cushion 1. The longitudinal belt bodies 32 are disposed in the main air chamber and are connected to the upper air cushion 1 and the lower air cushion 2 to provide a support, and the independent supporting effect is also provided by the sealed bag body structure of the annular belt body, the annular belt body is disposed around the air cushion bed, which can provide an independent support for edges, so that both edge portions and a middle position of the air cushion bed have a supporting strength after the air cushion bed is inflated, during use, no matter a user lies in any position of the air cushion bed, the air cushion bed can be kept flat, the user does not fall on the ground. By adopting the annular belt body and the longitudinal belt bodies for supporting, the longitudinal supporting force is improved, and the support is more stable. By adopting the longitudinal belt bodies for supporting, not only an inflation volume is reduced, but also inflation efficiency is improved. By disposing the fabric layer 4, a skin-friendly fabric is adopted, which is more comfortable.

Each of the embodiments of the present disclosure is described in a progressive manner, and each of the embodiments focuses on a difference from other embodiments, and same or similar parts between the embodiments can be seen with reference to each other. For a device disclosed in the embodiments, since the device corresponds to a method disclosed in the embodiments, so description is simple, please refer to description of the method section for related details.

The above description of the disclosed embodiments enables those skilled in the art to realize or use the present disclosure, various modifications to these embodiments are apparent to those skilled in the art, general principles defined in the present disclosure may be implemented in other embodiments without departing from the spirit or the scope of the present disclosure. Thus, the present disclosure is not limited to these embodiments described above, but should conform to the widest scope consistent with principles and novel features disclosed in present disclosure.

What is claimed is:

1. An air cushion bed, comprising:

an upper air cushion;

a lower air cushion; and a pull belt body;

wherein the pull belt body is disposed between the upper air cushion and the lower air cushion, and the upper air cushion and the lower air cushion are supported by the pull belt body; the pull belt body comprises an annular belt body and longitudinal belt bodies, the annular belt body is disposed along four sides of the upper air cushion and the lower air cushion, and the annular belt body is further connected to the upper air cushion and the lower air cushion, the longitudinal belt bodies are disposed between the upper air cushion and the lower air cushion, and two ends of the longitudinal belt bodies are connected to the upper air cushion and the lower air cushion, the annular belt body comprises a first sealed bag body structure spaced from the longitudinal belt bodies;

wherein each of the longitudinal belt bodies is a cuboid, having an upper side directly connected to the upper air cushion and a lower side directly connected to the lower air cushion.

2. The air cushion bed according to claim 1, the annular belt body comprises an inner surrounding belt and an outer surrounding belt, the inner surrounding belt and the outer surrounding belt form the first sealed bag body structure, and wherein the first inner surrounding belt, the upper air cushion, and the lower air cushion form a second sealed bag body structure.

3. The air cushion bed according to claim 1, a fabric layer is disposed on the upper air cushion.

4. The air cushion bed according to claim 1, an air inlet is disposed on the annular belt body.

5. The air cushion bed according to claim 4, a pump air device is disposed on the air inlet.

6. The air cushion bed according to claim 5, the pump air device is a manual pump air machine.

7. The air cushion bed according to claim 5, the pump air device is an electric pump air machine.

8. The air cushion bed according to claim 1, at least one anti-slip member is disposed at a bottom of the lower air cushion.

9. The air cushion bed according to claim 1, wherein the upper air cushion and the lower air cushion each comprise an outer rectangular frame and an inner fabric layer fully connected to inner sides of the outer rectangular frame;

wherein of each of the upper air cushion and the lower air cushion, the outer rectangular frame has a greater thickness than that of the inner fabric layer.

10. The air cushion bed according to claim 2, wherein the inner surrounding belt and the outer surrounding belt are arranged in parallel and spaced apart from each other without being connected along an entire height of the annular belt body.

11. The air cushion bed according to claim 9, wherein a lower side of the outer rectangular frame of the upper air cushion is directly connected with an upper side of the annular belt body, and an upper side of the outer rectangular frame of the lower air cushion is directly connected with a lower side of the annular belt body.

12. The air cushion bed according to claim 1, wherein the plurality of longitudinal belt bodies are arranged in parallel and are each arranged perpendicular to the upper air cushion and the lower air cushion.

* * * * *